US010093110B2

(12) United States Patent
Hattori

(10) Patent No.: US 10,093,110 B2
(45) Date of Patent: Oct. 9, 2018

(54) PRINTING APPARATUS AND PRINTING METHOD

(71) Applicant: TOSHIBA TEC KABUSHIKI KAISHA, Shinagawa-ku, Tokyo (JP)

(72) Inventor: Naoyuki Hattori, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 14 days.

(21) Appl. No.: 15/414,746

(22) Filed: Jan. 25, 2017

(65) Prior Publication Data

US 2018/0207952 A1 Jul. 26, 2018

(51) Int. Cl.
*B41J 2/355* (2006.01)
*B41J 2/325* (2006.01)

(52) U.S. Cl.
CPC ..... *B41J 2/355* (2013.01); *B41J 2/325* (2013.01)

(58) Field of Classification Search
CPC ..... B41J 2/325
See application file for complete search history.

(56) References Cited

U.S. PATENT DOCUMENTS 4,586,834 A * 5/1986 Hachisuga ..... B41J 35/18 347/172
9,216,596 B1 * 12/2015 Suzuki ..... B41J 11/663
2004/0169713 A1 * 9/2004 Niino ..... B41J 2/32 347/171
2009/0085996 A1 * 4/2009 Kasai ..... B41M 5/0011 347/100

FOREIGN PATENT DOCUMENTS

| | | | |
|---|---|---|---|
| EP | 2962856 | | 1/2016 |
| GB | 2147251 | | 5/1985 |
| JP | 2001-315374 | | 11/2001 |
| JP | 2005119065 | A * | 5/2005 |
| JP | 2016-068490 | | 5/2016 |
| JP | 2016-093982 | | 5/2016 |
| WO | 2016/001413 | | 1/2016 |

OTHER PUBLICATIONS

Extended European Search Report for European Patent Application No. 18153224.3 dated Jun. 11, 2018.

* cited by examiner

*Primary Examiner* — Kristal Feggins
*Assistant Examiner* — Kendrick Liu
(74) *Attorney, Agent, or Firm* — Amin, Turocy & Watson, LLP

(57) ABSTRACT

In accordance with an embodiment, a printing apparatus comprises a printing section, a first temperature sensor and a processor. The printing section carries out printing on a sheet through heating. The first temperature sensor measures a temperature of the sheet on which the printing section carries out the printing. The processor sets a heating amount on the basis of the temperature of the sheet and controls the printing section to carry out printing through the heating amount.

13 Claims, 3 Drawing Sheets

PRINTING APPARATUS AND PRINTING METHOD

FIELD

Embodiments described herein relate generally to a printing apparatus and a printing method.

BACKGROUND

There is a printing apparatus which forms an image on a sheet through heating an ink ribbon and a sheet which closely adhere to each other. A conventional printing apparatus forms an image according to a heat amount according to a temperature such as an outside air temperature.

However, the conventional printing apparatus cannot properly form an image in a case in which the temperature of the sheet or the ink ribbon is substantially different from the outside air temperature.

DETAILED DESCRIPTION

In accordance with an embodiment, a printing apparatus comprises a printing section, a first temperature sensor and a processor. The printing section carries out printing on a sheet through heating. The first temperature sensor measures a temperature of the sheet on which the printing section carries out the printing. The processor sets a heating amount on the basis of the temperature of the sheet and controls the printing section to carry out printing through the heating amount.

In accordance with another embodiment, printing method involving measuring a temperature of a sheet, setting a heating amount on the basis of the temperature of the sheet, and controlling a printing section which carries out printing on the sheet through heating to carry out printing through the heating amount.

Hereinafter, an embodiment is described with reference to the accompanying drawings.

A printing apparatus according to the embodiment is a printing apparatus with a thermal transfer system for forming an image on a medium through applying heat to an image forming material. The printing apparatus forms an image on the sheet with, for example, an ink ribbon as the image forming material. The printing apparatus heats the sheet and the ink ribbon which closely adhere to each other to form the image on the sheet. Further, the image formed by the printing apparatus is not limited to a specific configuration.

Figure 1:
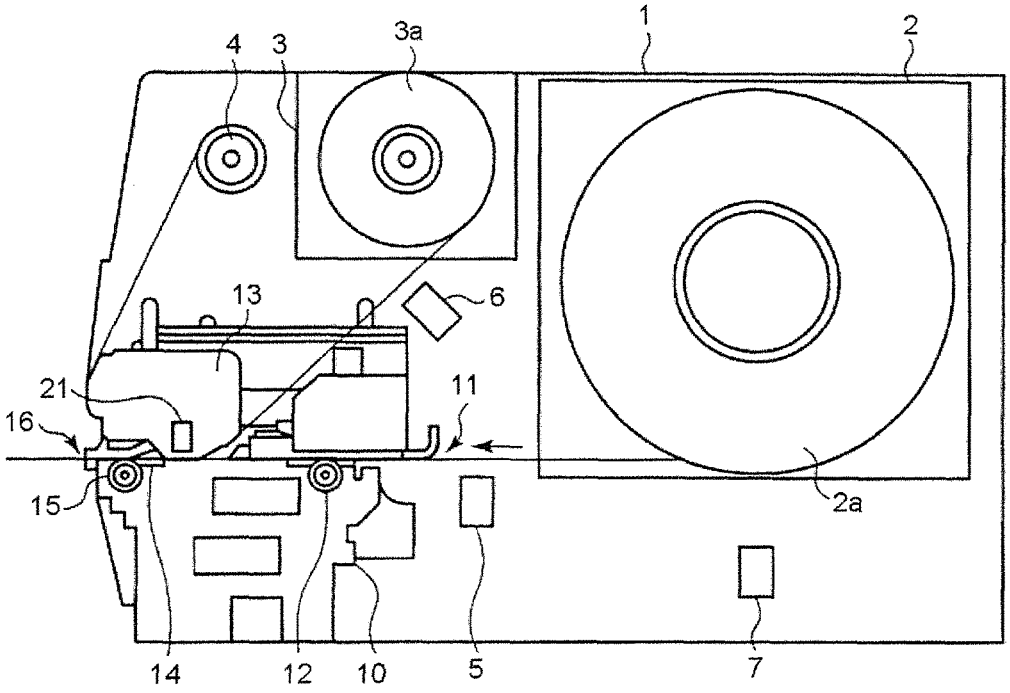
FIG. 1 is a diagram illustrating an example of the configuration of a printing apparatus according to an embodiment.

FIG. 1 is an example of the configuration of a printing apparatus 1.

As shown in FIG. 1, the printing apparatus 1 comprises a sheet storage section 2, an ink storage section 3, a roller 4, a temperature sensor 5, a temperature sensor 6, a temperature sensor 7 and a printing section 10. Furthermore, the printing apparatus 1 may properly add necessary components or delete unnecessary components.

The sheet storage section 2 stores a medium used for forming an image. In the printing apparatus 1 according to the embodiment, the sheet storage section 2 stores a sheet roll 2*a*. The sheet roll 2*a* is a band-like sheet formed into a roll shape. The sheet constituting the sheet roll 2*a* is formed with a predetermined width. For example, the sheet storage section 2 is provided with a rotatable shaft around which the sheet roll 2*a* is set. The sheet roll 2*a* is set around a rotatable shaft in the sheet storage section 2. The sheet roll 2*a* supplies a sheet band through rotating around the shaft of the sheet storage section 2. The sheet roll 2*a* is set in the printing apparatus 1 by an operator from outside.

The ink storage section 3 stores an ink ribbon roll 3*a*.

The ink ribbon roll 3*a* is an ink ribbon which is formed into a roll shape. The ink ribbon is an image forming material formed into a film shape. The ink ribbon becomes ink fixed on the sheet through heat. For example, the ink storage section 3 is provided with a rotatable shaft around which the ink ribbon roll 3*a* is set. The ink ribbon roll 3*a* is set around the rotatable shaft in the ink storage section 3. As a result, the ink ribbon roll 3*a* supplies the ink ribbon through rotating around the shaft in the ink storage section 3. The ink ribbon supplied from the ink ribbon roll 3*a* fixes the ink on the sheet through being heated in a state in which the ink ribbon closely adheres to the sheet.

The roller 4 is arranged in a predetermined position in the printing apparatus 1. The roller 4 rotates in conjunction with a drive section. The roller 4 winds the ink ribbon after the ink is fixed on the sheet. The ink ribbon supplied from the ink ribbon roll 3*a* passes through a thermal head 21 described later and reaches the roller 4. The roller 4 winds the ink ribbon passing through the thermal head 21. The roller 4 supplies a new ink ribbon from the ink ribbon roll 3*a* to the printing section 10 through winding the ink ribbon.

The temperature sensor 5 measures the temperature of the sheet forming the sheet roll 2*a*. The temperature sensor 5 measures the temperature of the sheet before the sheet supplied from the sheet roll 2*a* reaches an image forming position in the printing section 10 (at a position before the sheet is conveyed to the image forming position). For example, the temperature sensor 5 measures the temperature of the sheet at a position between the sheet storage section 2 and the image forming position in the printing section 10. Further, the temperature sensor 5 may measure the temperature of the sheet before the sheet reaches the image forming position in the printing section 10. For example, the temperature sensor 5 may measure the temperature of the sheet in the sheet storage section 2.

The temperature sensor 5 measures the temperature of the sheet in a non-contact manner. For example, the temperature sensor 5 measures the temperature through receiving light such as an infrared ray.

Further, the temperature sensor 5 may measure the temperature of the sheet through contacting with the sheet. For example, the temperature sensor 5 may be a thermistor.

The temperature sensor 6 measures the temperature of the ink ribbon constituting the ink ribbon roll 3*a*. The temperature sensor 6 measures the temperature of the ink ribbon before the ink ribbon supplied from the ink ribbon roll 3*a* reaches the image forming position in the printing section 10 (at a position before the ink ribbon is conveyed to the image forming position). For example, the temperature sensor 6 measures the temperature of the ink ribbon at a position between the ink storage section 3 and the image forming position in the printing section 10. Furthermore, the temperature sensor 6 may be any temperature sensor as long as it measures the temperature of the ink ribbon before the ink ribbon reaches the image forming position in the printing section 10. For example, the temperature sensor 6 may measure the temperature of the ink ribbon in the ink storage section 3.

The temperature sensor 6 measures the temperature of the ink ribbon in a non-contact manner. For example, the temperature sensor 6 measures the temperature through receiving light such as an infrared ray.

Further, the temperature sensor 6 may measure the temperature of the ink ribbon through contacting with the sheet. For example, the temperature sensor 6 may be a thermistor.

The temperature sensor 7 (atmospheric temperature sensor) measures an atmospheric temperature. For example, the temperature sensor 7 measures the temperature in the printing apparatus 1 as the atmospheric temperature. The temperature sensor 7 is arranged at a predetermined position in the printing apparatus 1. For example, the temperature sensor 7 is a thermistor. Further, the temperature sensor 7 may measure a temperature of the outside of the printing apparatus 1 as the atmospheric temperature.

The printing section 10 uses the ink ribbon supplied from the ink ribbon roll 3*a* to form the image on the sheet supplied from the sheet roll 2*a*. The printing section 10 cuts the sheet on which the image is formed into a predetermined size. The printing section 10 discharges the cut sheet.

The printing section 10 includes an inlet 11, a roller 12, an image forming section 13, a cutting section 14, a roller 15 and a discharge port 16.

The inlet 11 is arranged at a position where the sheet supplied from the sheet roll 2*a* is taken in.

The roller 12 is formed between the inlet 11 and the image forming section 13. The roller 12 is rotated through a drive mechanism. The roller 12 conveys the sheet that is taken in from the inlet 11. For example, the roller 12 conveys the sheet taken in from the inlet 11 to the image forming section 13.

The image forming section 13 (printing section) heats the ink ribbon to form the image on the sheet. For example, the image forming section 13 forms the image on the sheet on the basis of print data stored in an internal memory section or print data supplied from an external device.

The image forming section 13 is provided with the thermal head 21. The image forming section 13 is formed by sandwiching the sheet and the ink ribbon closing adhering to each other between a stand (or the roller) formed at a lower part of the image forming section 13 and the thermal head 21. For example, as shown in FIG. 1, the image forming section 13 is formed in such a manner that the ink ribbon and the sheet pass through a lower part of the thermal head 21. Further, the image forming section 13 may include a component for energizing the thermal head 21 to a stand side (lower side).

The thermal head 21 heats the sheet and the ink ribbon. For example, the thermal head 21 receives supply of electric power from a power supply section (not shown). The thermal head 21 heats the sheet and the ink ribbon through the supplied electric power.

The thermal head 21 can set a heating area. For example, a CPU 31 sets a heating area to the thermal head 21 on the basis of the print data.

The cutting section 14 cuts the sheet on which the image is formed into a predetermined size. For example, the cutting section 14 is provided with a blade. The cutting section 14 is formed at the discharge port 16 side with respect to the image forming section 13. The cutting section 14 cuts the sheet drawn out from the sheet roll 2*a* at a timing at which a length in a conveyance direction of the conveyed sheet in the printing section 10 to a predetermined size.

The roller 15 discharges the sheet cut by the cutting section 14 towards the discharge port 16. The roller 15 is rotated by a drive mechanism. The roller 15 is formed at the discharge port 16 side with respect to the cutting section 14.

The discharge port 16 is arranged at a position for discharging the cut sheet to the outside.

Next, a control system of the printing apparatus 1 is described.

Figure 2:
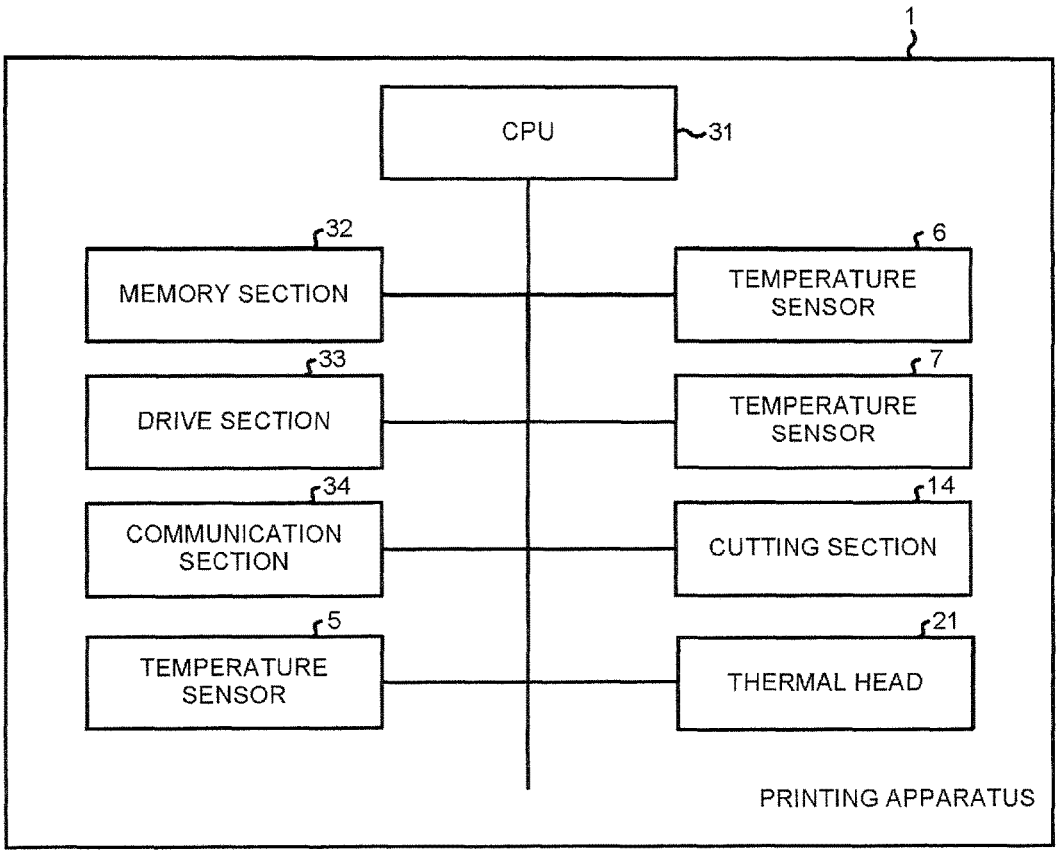
FIG. 2 is a block diagram illustrating an example of the configuration of the printing apparatus according to the embodiment.

FIG. 2 is a block diagram illustrating an example of the configuration of a control system in the printing apparatus 1.

As shown in FIG. 2, the printing apparatus 1 comprises the temperature sensor 5, the temperature sensor 6, the temperature sensor 7, the cutting section 14, the thermal head 21, the CPU 31 (processor), a memory section 32, a drive section 33 and a communication section 34.

The CPU 31 is mutually connected with the temperature sensor 5, the temperature sensor 6, the temperature sensor 7, the cutting section 14, the thermal head 21, the memory section 32, the drive section 33 and the communication section 34 in a communicable manner via a data bus.

The temperature sensor 5, the temperature sensor 6, the temperature sensor 7, the cutting section 14 and the thermal head 21 are as mentioned above.

The CPU 31 controls the entire printing apparatus 1. The CPU 31 may include an internal cache and various interfaces. The CPU 31 executes a program stored in advance in the internal memory or the memory section 32 to realize various processing. The CPU 31 may be any processor as long as it can realize control of each section of the printing apparatus 1 and information processing by executing a program.

Apart of the various functions realized by the CPU 31 through executing the program may be realized by a hardware circuit. In this case, the CPU 31 controls the functions realized by the hardware circuit.

The memory section 32 is composed of a volatile memory and a nonvolatile memory. For example, the memory section 32 stores control programs, control data and the like in advance. The memory section 32 temporarily stores data being processed by the CPU 31. For example, the memory section 32 stores various application programs that is executed based on a command from the CPU 31. The memory section 32 may also store data required for executing the application program and an execution result of the application program.

The drive section 33 drives each section of the printing apparatus 1 according to a signal from the CPU 31. For example, the drive section 33 drives the roller 4, the roller 12 and the roller 15. For example, the drive section 33 is formed by a motor and a driver for driving the motor. The drive section 33 may include a motor for each roller or may drive some rollers with one motor.

The communication section 34 is an interface for sending and receiving data to and from a host device. For example, the communication section 34 may communicate with the host device through an external network such as an internet. The communication section 34 may communicate with the host device through an internal network. The communication section 34 is, for example, an interface supporting LAN connection.

Next, the function realized by the CPU 31 is described. The CPU 31 has a function of acquiring the print data indicating an image to be printed on the sheet. For example, the CPU 31 acquires the print data from an external device via the communication section 34. The CPU 31 may also acquire the print data from the memory section 32.

The CPU 31 has a function of acquiring the temperature of the sheet, the temperature of the ink ribbon and the temperature (atmospheric temperature) in the printing apparatus 1.

For example, the CPU 31 acquires the temperature of the sheet via the temperature sensor 5. The CPU 31 acquires the temperature of the ink ribbon via the temperature sensor 6. The CPU 31 acquires the temperature in the printing apparatus 1 via the temperature sensor 7.

The CPU 31 may acquire a value obtained by averaging the temperature acquired in a predetermined period from the temperature sensor 5 as the temperature of the sheet. The CPU 31 may also acquire a value obtained by averaging the temperature acquired in a predetermined period as the temperature of the ink ribbon and the temperature in the printing apparatus 1.

The CPU 31 has a function of determining the heating amount applied to the sheet and the ink ribbon by the thermal head 21 on the basis of at least one of the temperature of the sheet and the temperature of the ink ribbon in addition to the temperature in the printing apparatus 1.

The heating amount is applied to the sheet and the ink ribbon by the thermal head 21 to form an image. For example, the heating amount may be the temperature of the thermal head 21, or a voltage or a current applied to the thermal head 21. The heating amount may be time for which the thermal head 21 heats the sheet and the ink ribbon. The parameter constituting the heating amount is not limited to a specific configuration.

For example, the CPU 31 determines the heating amount according to the temperature in the printing apparatus 1. The CPU 31 adjusts the heating amount in response to the temperature in the printing apparatus 1 in such a manner that the hating amount becomes higher if the temperature of the sheet or the temperature of the ink ribbon becomes lower. The CPU 31 adjusts the heating amount in response to the temperature in the printing apparatus 1 in such a manner that the heating amount becomes lower if the temperature of the sheet or the temperature of the ink ribbon becomes higher.

For example, the CPU 31 calculates a first difference between the temperature in the printing apparatus 1 and the temperature of the sheet. The CPU 31 calculates a second difference between the temperature in the printing apparatus 1 and the temperature of the ink ribbon. The CPU 31 compares the two differences to determine the heating amount on the basis of the greater one.

The CPU 31 may determine the heating amount on the basis of a total value obtained by respectively calculating predetermined coefficients to the first difference and the second difference.

The CPU 31 calculates a difference between the temperature of a predetermined standard and the temperature of the sheet. The CPU 31 calculates a difference between the temperature of the predetermined standard and the temperature of the ink ribbon. The CPU 31 compares the two differences to determine the heating amount on the basis of the greater one.

The CPU 31 may determine the heating amount on the basis of the temperature of the sheet. The CPU 31 may determine the heating amount on the basis of the temperature of the ink ribbon.

The method by the CPU 31 for determining the heating amount is not limited to a specific method.

The CPU 31 has a function of cutting the sheet on which the image is formed.

For example, the CPU 31 uses the roller 12 to convey the sheet to a predetermined position. The CPU 31 uses the cutting section 14 to cut the sheet located at the predetermined position.

Next, an example of the operation of the printing apparatus 1 is described.

Figure 3:
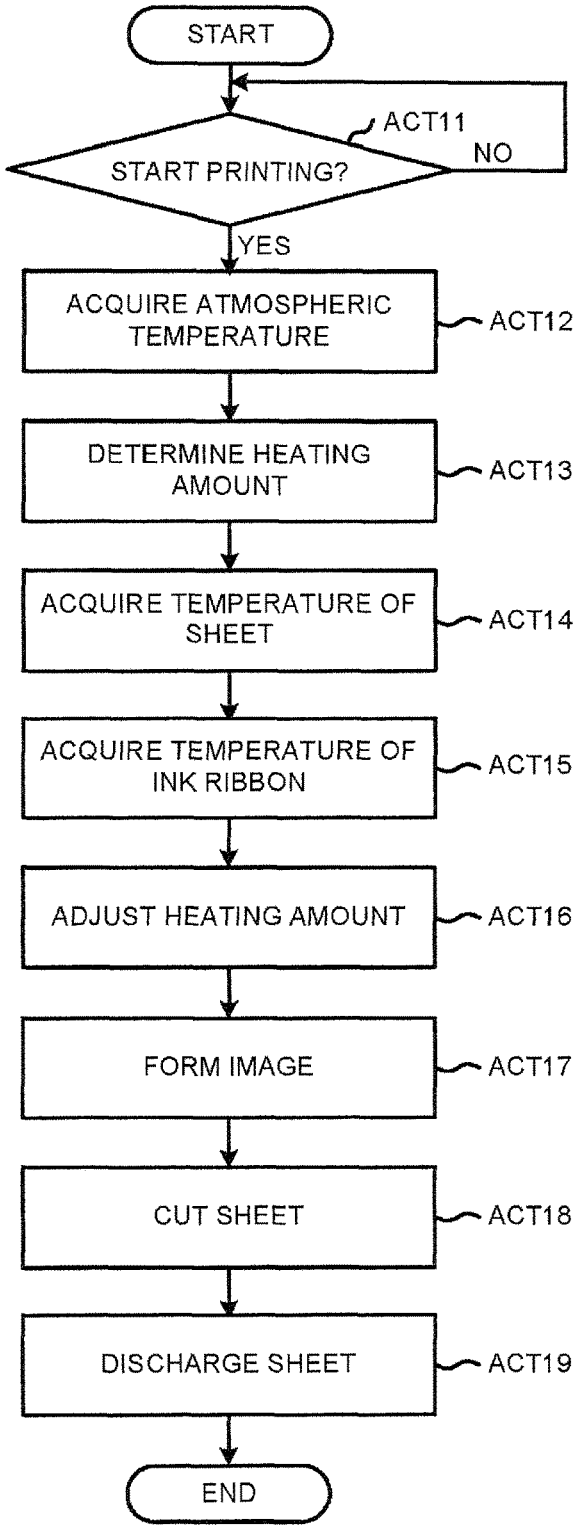
FIG. 3 is a flowchart illustrating an example of the operation of the printing apparatus according to the embodiment.

FIG. 3 is a flowchart illustrating an example of the operation of the printing apparatus 1.

The CPU 31 of the printing apparatus 1 determines whether or not the printing of the image is started (ACT 11). For example, the CPU 31 determines whether or not an operation for starting the printing is received via an operation section (not shown). The CPU 31 may determine whether or not the print data is received via the communication section 34.

If it is determined that the printing of the image is not started (No in ACT 11), the CPU 31 returns to the processing in ACT 11.

If it is determined that the printing of the image is started (Yes in ACT 11), the CPU 31 acquires the atmospheric temperature (ACT 12). If the atmospheric temperature is acquired, the CPU 31 determines the heating amount in response to the atmospheric temperature (ACT 13).

If the heating amount is determined in response to the atmospheric temperature, the CPU 31 acquires the temperature of the sheet via the temperature sensor 5 (ACT 14). If the temperature of the sheet is acquired, the CPU 31 acquires the temperature of the ink ribbon via the temperature sensor 6 (ACT 15). If the temperature of the ink ribbon is acquired, the CPU 31 adjusts the heating amount on the basis of the temperature of the sheet and the temperature of the ink ribbon (ACT 16).

If the heating amount is adjusted, the CPU 31 heats the ink ribbon in accordance with the adjusted heating amount to form the image on the sheet (ACT 17). If the image is formed on the sheet, the CPU 31 uses the cutting section 14 to cut the sheet on which the image is formed to the predetermined size (ACT 18). If the sheet is cut, the CPU 31 uses the drive section 33 to discharge the cut sheet from the discharge port 16 (ACT 19).

If the sheet is discharged from the discharge port 16, the CPU 31 terminates the operation.

Further, the CPU 31 may execute the processing in ACT 12, ACT 14 and ACT 15 in any order. The CPU 31 may execute the processing in ACT 12, ACT 14 and ACT 15 in parallel.

In a case in which the CPU 31 determines the heating amount on the basis of the temperature of the sheet, the processing in ACT 12, ACT 13, ACT 15 and ACT 16 may not be executed. In a case in which the CPU 31 determines the heating amount on the basis of the temperature of the ink ribbon, the processing in ACT 12, ACT 13, ACT 14 and ACT 16 may not be executed. In a case in which the CPU 31 determines the heating amount on the basis of the temperature of the sheet and the temperature of the ink ribbon, the processing in ACT 12, ACT 13 and ACT 16 may not be executed.

Further, the foregoing embodiment is not limited to the printing apparatus which uses the ink ribbon to form the image. For example, the foregoing embodiment is also easily applicable to a printing apparatus which forms the image on a thermal sheet which contains the image forming material.

The printing apparatus 1 may also be a device for forming the image on a sheet which is cut to the predetermined size in advance. In this case, the printing apparatus 1 may store the sheet that is cut into the predetermined size in the sheet storage section 2. The printing apparatus 1 may not include the cutting section 14.

The printing apparatus with the foregoing configuration acquires the temperature of the sheet and the temperature of the ink ribbon. The printing apparatus determines the heating amount for forming the image on the basis of the temperature of the sheet and the temperature of the ink ribbon. Thus, the printing apparatus can adjust the heating amount according to the temperature of the sheet and the temperature of the ink ribbon. As a result, the printing apparatus can prevent irregularity from being generated in a printing state according to the temperature of the sheet and the temperature of the ink ribbon.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printing apparatus, comprising:

a printing section configured to carry out printing on a sheet through heating;

a first temperature sensor configured to measure a temperature of the sheet on which the printing section carries out the printing;

a processor configured to set a heating amount on the basis of the temperature of the sheet and control the printing section to carry out the printing through the heating amount;

a second temperature sensor configured to measure a temperature of an ink ribbon; and an atmospheric temperature sensor configured to measure an atmospheric temperature, wherein the printing section carries out printing on the sheet through heating the ink ribbon, the processor further sets the heating amount on the basis of the temperature of the ink ribbon, and the processor further sets the heating amount according to the atmospheric temperature.

2. The printing apparatus according to claim 1, further comprising:

an atmospheric temperature sensor configured to measure an atmospheric temperature, wherein the processor sets the heating amount according to the atmospheric temperature, and sets the heating amount on the basis of a greater difference obtained by comparing a difference between the temperature of the sheet and the atmospheric temperature and a difference between the temperature of the ink ribbon and the atmospheric temperature.

3. The printing apparatus according to claim 1, wherein the first temperature sensor measures the temperature of the sheet in a non-contact manner.

4. The printing apparatus according to claim 1, further comprising:

a roller configured to convey the sheet to the printing section, wherein the first temperature sensor measures the temperature of the sheet at a position before the sheet is conveyed to the printing section.

5. The printing apparatus according to claim 4, further comprising:

a storage section configured to store a sheet roll formed into a roll shape as the sheet conveyed to the printing section, wherein the first temperature sensor measures the temperature of the sheet stored in the storage section.

6. The printing apparatus according to claim 1, wherein the second temperature sensor measures the temperature of the ink ribbon in a non-contact manner.

7. A printing method, including:

measuring a temperature of a sheet, setting a heating amount on the basis of the temperature of the sheet, controlling a printing section which carries out printing on the sheet through heating to carry out printing through the heating amount, measuring a temperature of an ink ribbon, printing on the sheet through heating the ink ribbon, setting the heating amount on the basis of the temperature of the ink ribbon, measuring an atmospheric temperature, and further setting the heating amount according to the atmospheric temperature.

8. The printing method according to claim 7, further comprising:

measuring an atmospheric temperature, and setting the heating amount according to the atmospheric temperature, and further setting the heating amount on the basis of a greater difference obtained by comparing a difference between the temperature of the sheet and the atmospheric temperature and a difference between the temperature of the ink ribbon and the atmospheric temperature.

9. The printing method according to claim 7, wherein measuring the temperature of the sheet comprises measuring in a non-contact manner.

10. The printing method according to claim 7, further comprising:

conveying the sheet to the printing section, and measuring the temperature of the sheet at a position before the sheet is conveyed to the printing section.

11. The printing method according to claim 10, further comprising:

storing a sheet roll formed into a roll shape as the sheet conveyed to the printing section, and measuring the temperature of the sheet stored in the storage section.

12. The printing method according to claim 7, wherein measuring the temperature of the ink ribbon comprises measuring in a non-contact manner.

13. A printing apparatus, comprising:

a printing section configured to carry out printing on a sheet through heating;

a first temperature sensor configured to measure a temperature of the sheet on which the printing section carries out the printing;

a second temperature sensor configured to measure a temperature of an ink ribbon;

an atmospheric temperature sensor configured to measure an atmospheric temperature;

a processor configured to set the heating amount a) according to the atmospheric temperature and b) on the basis of a greater difference obtained by comparing a difference between the temperature of the sheet and the atmospheric temperature and a difference between the temperature of the ink ribbon and the atmospheric temperature, and control the printing section to carry out the printing through the heating amount.

* * * * *